US006107906A

United States Patent [19]

Caiozza

[11] Patent Number: 6,107,906

[45] Date of Patent: Aug. 22, 2000

[54] MAGNET ARRAY AND SUPPORT BRACKET

[76] Inventor: Joseph Caiozza, 321 W. Market St., Long Beach, N.Y. 11561

[21] Appl. No.: 09/299,500

[22] Filed: Apr. 26, 1999

[51] Int. Cl.[7] ..... H01F 7/02

[52] U.S. Cl. ..... 335/306; 335/296; 335/297; 123/538; 210/222

[58] Field of Search ..... 335/302–306, 335/296, 297, 298, 301; 210/222, 223; 123/536–539

[56] References Cited

U.S. PATENT DOCUMENTS

| | | | |
|---|---|---|---|
| 3,059,156 | 10/1962 | Moriya | 335/306 |
| 3,412,352 | 11/1968 | Watson | 335/306 |
| 5,273,648 | 12/1993 | Caiozza | 210/222 |
| 5,510,024 | 4/1996 | Caiozza | 210/186 |

*Primary Examiner*—Michael L. Gellner
*Assistant Examiner*—Raymond Barrera

[57] ABSTRACT

A magnet array for mounting on an oil filter cartridge includes a pair of magnetic shunt end pieces. A plurality of magnets are aligned parallel to one another and extend between the magnetic shunt end pieces and contact internal faces of the magnetic shunt end pieces such that the magnetic shunt end pieces and the magnets are retained in a stable magnet array by the magnetic interaction between the magnetic shunt end pieces and the magnets. The magnetic shunt end pieces can be in a form of cylindrical end pieces such that a cylindrical magnet array is formed, can be in a form of triangular end pieces such that a triangular magnet array is formed, and can be in a form of rectangular end pieces such that a box-like magnet array is formed. Each of the triangular end pieces and the rectangular end pieces includes a concave mounting surface. A support bracket is provided for supporting the magnet array on an oil filter cartridge. Wires can be used to bind the magnetic shunt end pieces onto the magnets. The support bracket includes a magnet cover portion for covering the magnets in the magnet array. First and second end-piece cover portions extend from the magnet cover portion for covering first and second magnetic shunt end pieces. The magnet cover portion includes mounting strap reception slots for receiving a mounting strap for mounting the magnet array and the support bracket on a oil filter cartridge.

12 Claims, 4 Drawing Sheets

FIG 4
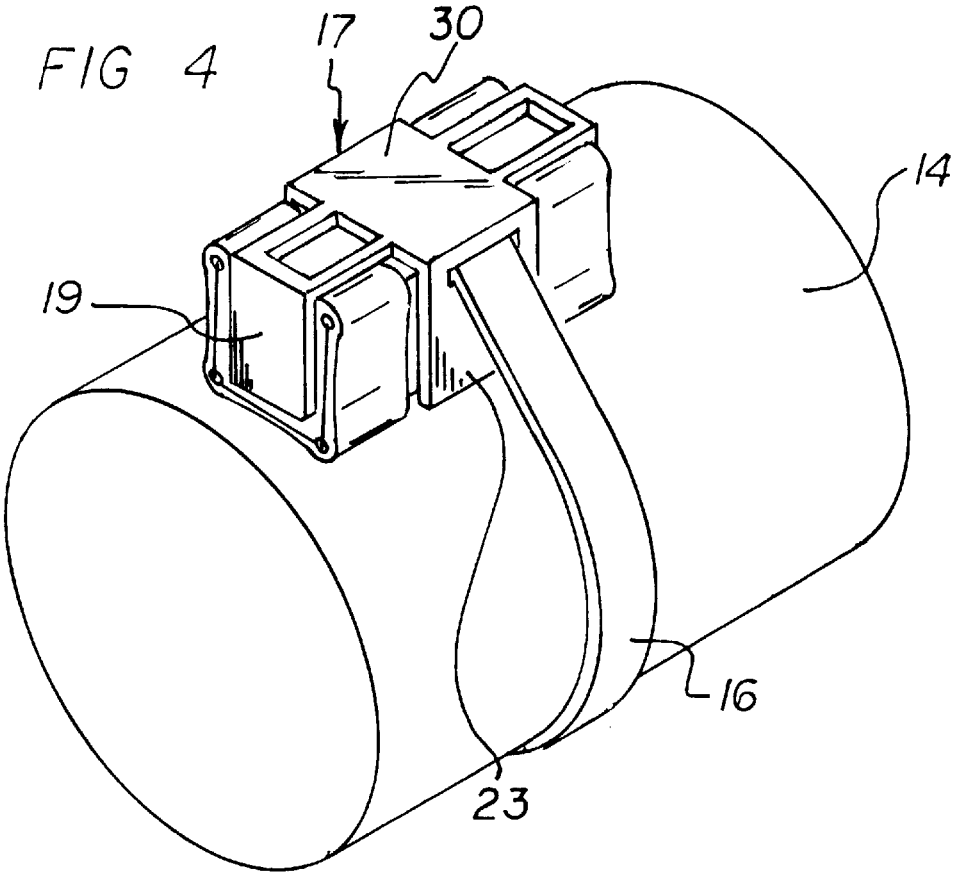
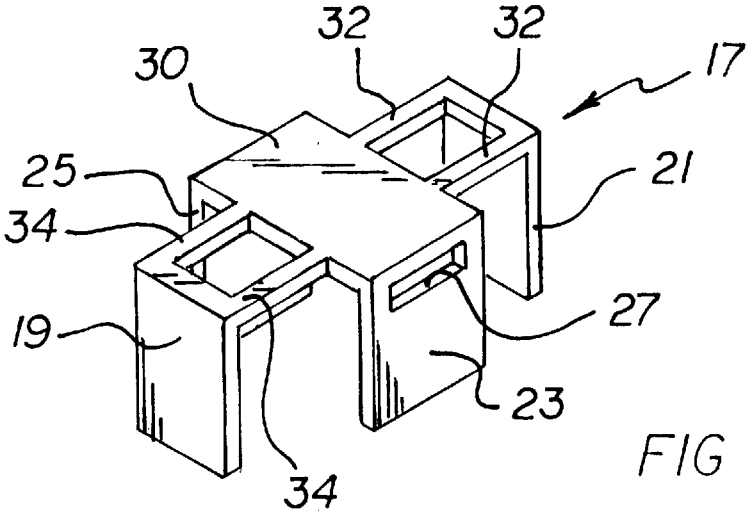
FIG 5

MAGNET ARRAY AND SUPPORT BRACKET

BACKGROUND OF TIE INVENTION

1. Field of the Invention

The present invention relates generally to magnetic attachments to oil filter cartridges and, more particularly, to devices especially adapted for supporting a plurality of magnets on an oil filter cartridge.

2. Description of the Prior Art

For internal combustion engines, filtering engine oil to remove unwanted particles is an important function to extend engine life. The present inventor has previously invented devices for aiding in the trapping of metallic particles in oil filter cartridges based on the use of magnets attached to the outside of the oil filter cartridges. These previous magnet-based devices are set forth in U.S. Pat. No. 5,273,648 and in U.S. Pat. No. 5,510,024, both of which are incorporated herein by reference.

It is noted that in both U.S. Pat. No. 5,273,648 and in U.S. Pat. No. 5,510,024, magnets are arrayed beside one another in a substantially two-dimensional plane. However, it has been discovered by the present inventor that additional benefits in increasing magnetic strength can be achieved when magnets are arrayed in a three-dimensional array. In this respect, it would be desirable if magnets for treatment of engine oil in an oil filter cartridge were arrayed in a three-dimensional array.

In addition, it has been discovered by the present inventor that a three-dimensional array of magnets is very desirable when the magnets extend longitudinally, such as cylindrical or bar magnets, and when the magnets are arrayed side-by-side and parallel to one another. In this respect, it would be desirable if a device were provided for retaining a plurality of longitudinally extending magnets in an array wherein the magnets are parallel to one another.

To retain longitudinally extending magnets in parallel in a three-dimensional array, and to increase overall cumulative magnetic effect, it would be desirable if the magnets are retained in the array by end pieces which receive the respective ends of the magnets. That is, one end piece receives the north pole ends of the magnets, and the other end piece receives the south pole ends of the magnets. The overall form of the three-dimensional array could have a number of variations. For example, the three-dimensional array could be cylindrical in shape, triangular in shape, or box-like in shape. The overall form of the three-dimensional array would dictate the shape of the end pieces. For example, if the longitudinally extending magnets are arrayed in a cylindrical shape, the end pieces would be round. If the longitudinally extending magnets are arrayed in a triangular shape, the end pieces would be triangular. If the longitudinally extending magnets are arrayed in a boxlike array, the end pieces would be rectangular.

A magnet array is attached to an oil filter cartridge using a support bracket. In this respect, it would be desirable if a support bracket could accommodate cylindrical, triangular, and box-like end pieces for the three-dimensional magnet arrays.

Oil filter cartridges come in a variety of sizes. More specifically, the curved outside surfaces of different oil filter cartridges can have different radii of curvature. In this respect, it would be desirable if end pieces for the three-dimensional magnet arrays had a variety of radii of curvature for fitting onto a variety of oil filter cartridges.

As disclosed in the above-mentioned U.S. Pat. No. 5,273,648 and U.S. Pat. No. 5,510,024, a preferred element for attaching a support bracket to an oil filter cartridge is a strap or band. In this respect, it would be desirable if a support bracket for a three-dimensional array of magnets had means for receiving a strap or band used to attach the magnet array to the oil filter cartridge.

Thus, while the above-mentioned prior art indicates it to be well known to attach magnet arrays to oil filter cartridges, the prior art described above does not teach or suggest a magnet array and support bracket which has the following combination of desirable features: (1) provides magnets for treatment of engine oil in an oil filter cartridge in a three-dimensional array; (2) retains a plurality of longitudinally extending magnets in an array wherein the magnets are parallel to one another; (3) provides a three-dimensional magnet array that can be cylindrical in shape, triangular in shape, or box-like in shape; (4) provides a support bracket that can accommodate cylindrical, triangular, and boxlike end pieces for the three-dimensional magnet arrays; (5) provides end pieces for the three-dimensional magnet arrays that have a variety of radii of curvature for fitting onto a variety of oil filter cartridges; and (6) provides a support bracket for a three-dimensional array of magnets that has means for receiving a strap or band used to attach the magnet array to the oil filter cartridge. The foregoing desired characteristics are provided by the unique magnet array and support bracket of the present invention as will be made apparent from the following description thereof. Other advantages of the present invention over the prior art also will be rendered evident.

SUMMARY OF THE INVENTION

To achieve the foregoing and other advantages, the present invention, briefly described, provides a magnet array for mounting on an oil filter cartridge includes a pair of magnetic shunt end pieces, each of which includes an internal face having an internal surface area. A plurality of cylindrical magnets are aligned parallel to one another and extend between the magnetic shunt end pieces and contact the internal faces such that the magnetic shunt end pieces and the magnets are retained in a stable magnet array by the magnetic interaction between the magnetic shunt end pieces and the magnets. The magnetic shunt end pieces can be in a form of cylindrical end pieces, such that a cylindrical magnet array is formed. The magnetic shunt end pieces can be in a form of triangular end pieces, such that a triangular magnet array is formed. The magnetic shunt end pieces can be in a form of rectangular end pieces, such that a box-like magnet array is formed. Each of the triangular end pieces includes a concave mounting surface. Each of the rectangular end pieces includes a concave mounting surface. The magnetic shunt end pieces include wire-reception channels for receiving safety wires for binding the magnetic shunt end pieces and the magnets into a more secure magnet array.

A support bracket is provided for supporting the magnet array on an oil filter cartridge. The support bracket includes a magnet cover portion which includes a top cover portion. A first side cover portion extends downward from the top cover portion, and a second side cover portion extends downward from the top cover portion. The magnets in the magnet array are covered by the magnet cover portion. A first end-piece cover portion extends from the top cover portion for covering a first magnetic shunt end piece. The first end-piece cover portion includes first strut members extending over top portions of the first magnetic shunt end piece and includes a first outer end cover ending downward from the first strut members for covering an outer end of the first magnetic shunt end piece. A second end-piece cover portion extends from the top cover portion for covering a second magnetic shunt end piece. The second end-piece cover portion includes second strut members extending over top portions of the second magnetic shunt end piece and includes a second outer end cover extending downward from the second strut members for covering an outer end of the second magnetic shunt end piece.

Each of the first side cover portion and the second side cover portion includes a mounting strap reception slot for receiving a mounting strap for mounting the magnet array and the support bracket on a oil filter cartridge. The magnetic shunt end pieces include concave mounting surfaces for mounting on convex outer surfaces of oil filter cartridges.

With another embodiment of the invention, each magnetic shunt end piece includes a plurality of concave mounting surfaces has a plurality of different radii of curvature for mounting of different oil filter cartridges has different convex outer surfaces has different radii of curvature.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved magnet array and support bracket which has all of the advantages of the prior art and none of the disadvantages.

It is another object of the present invention to provide a new and improved magnet array and support bracket which may be easily and efficiently manufactured and marketed.

It is a further object of the present invention to provide a new and improved magnet array and support bracket which is of durable and reliable construction.

An even further object of the present invention is to provide a new and improved magnet array and support bracket which is susceptible of a low cost of manufacture with regard to both materials and labor, and which accordingly is then susceptible of low prices of sale to the consuming public, thereby making such magnet array and support bracket available to the buying public.

Still yet a further object of the present invention is to provide a new and improved magnet array and support bracket which has magnets for treatment of engine oil in an oil filter cartridge in a three-dimensional array.

Still another object of the present invention is to provide a new and improved magnet array and support bracket that retains a plurality of longitudinally extending magnets in an array wherein the magnets are parallel to one another.

Yet another object of the present invention is to provide a new and improved magnet array and support bracket which has a three-dimensional magnet array that can be cylindrical in shape, triangular in shape, or box-like in shape.

Even another object of the present invention is to provide a new and improved magnet array and support bracket that has a support bracket that can accommodate cylindrical, triangular, and box-like end pieces for the three-dimensional magnet arrays.

Still a further object of the present invention is to provide a new and improved magnet array and support bracket which has end pieces for the three-dimensional magnet arrays that have a variety of radii of curvature for fitting onto a variety of oil filter cartridges.

Yet another object of the present invention is to provide a new and improved magnet array and support bracket that provides a support bracket for a three-dimensional array of magnets that has means for receiving a strap or band used to attach the magnet array to the oil filter cartridge.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 4 is a perspective view showing the three-dimensional box-like magnet array of FIG. 3 attached to an oil filter cartridge using a support bracket of the invention and a strap.

FIG. 5 is a perspective view of the support bracket of the invention shown in FIG. 3 removed from the oil filter cartridge and the strap.

DESCRIPTION OF THE PREFERRED EMBODIMENT

Figure 1:
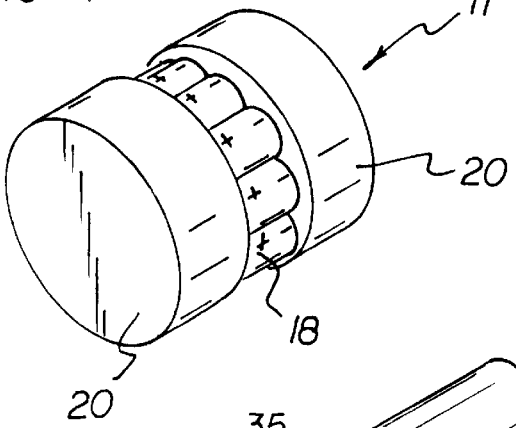
FIG. 1 is a perspective view showing an embodiment of the three-dimensional magnet array of the invention having a cylindrical shape with round end pieces.
Figure 2:
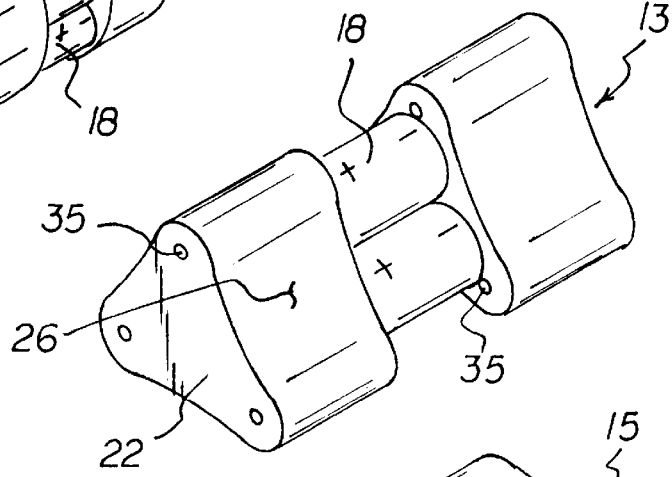
FIG. 2 is a perspective view showing an embodiment of the three-dimensional magnet array of the invention having a triangular shape with triangular end pieces.
Figure 3:
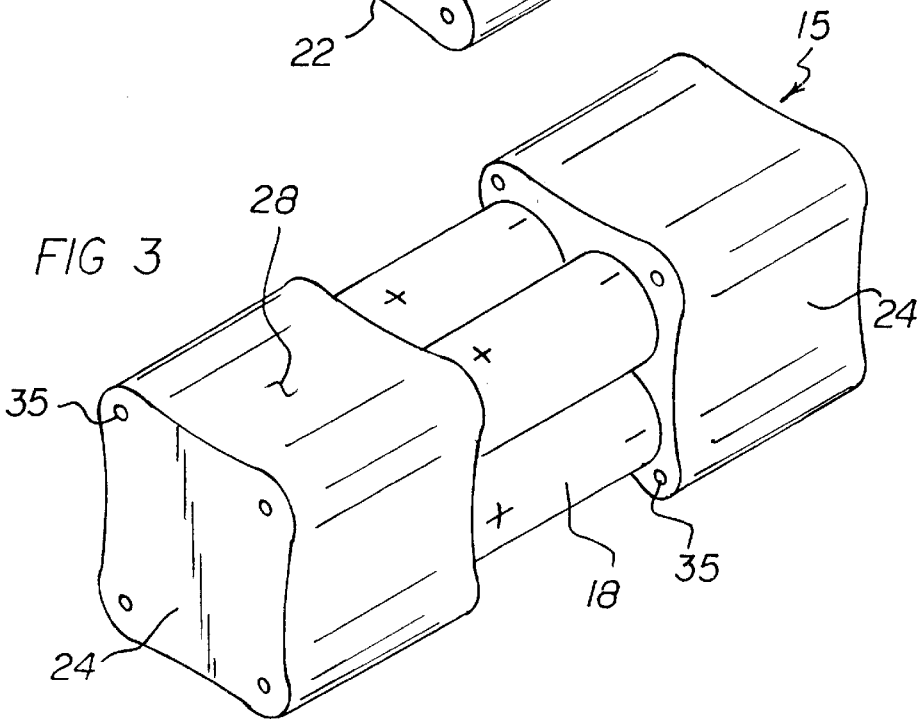
FIG. 3 is a perspective view showing an embodiment of the three-dimensional magnet array of the invention having a box-like shape with rectangular end pieces.
Figure 6:
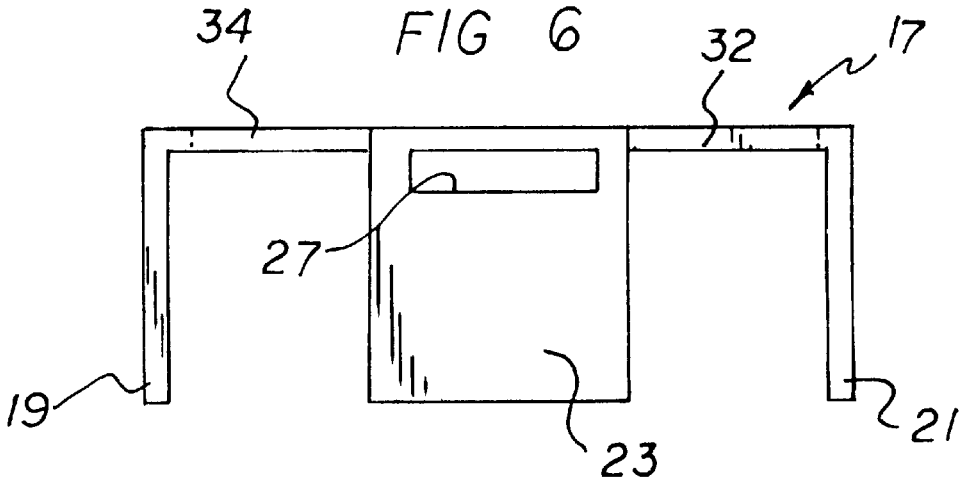
FIG. 6 is an enlarged side view of the support bracket of the invention shown in FIG. 5.

With reference to the drawings, a new and improved magnet array and support bracket embodying the principles and concepts of the present invention will be described.

Turning to the Figures, magnet array 10 includes a pair of magnetic shunt end pieces, each of which includes an internal face having an internal surface area. A plurality of cylindrically shaped magnets 18 are aligned parallel to one another and extend between the magnetic shunt end pieces and contact the internal faces such that the magnetic shunt end pieces and the magnets 18 are retained in a stable magnet array by the magnetic interaction between the magnetic shunt end pieces and the magnets 18. The magnetic shunt end pieces can be in a form of cylindrical end pieces 20, such that a cylindrical magnet array 11 is formed. The magnetic shunt end pieces can be in a form of triangular end pieces 22, such that a triangular magnet array 13 is formed. The magnetic shunt end pieces can be in a form of rectangular end pieces 24, such that a box-like magnet array 15 is formed. Each of the triangular end pieces 22 includes a concave mounting surface 26. Each of the rectangular end pieces 24 includes a concave mounting surface 28. The magnetic shunt end pieces include wire-reception channels 35 for receiving safety wires (not shown) for binding the magnetic shunt end pieces and the magnets 18 into a more secure magnet array 10.

A support bracket 17 is provided for supporting the magnet array 10 on an oil filter cartridge 14. The support bracket 17 includes a magnet cover portion which includes a top cover portion 30. A first side cover portion 23 extends downward from the top cover portion 30, and a second side cover portion 25 extends downward from the top cover portion 30. The magnets 18 in the magnet array 10 are covered by the magnet cover portion. A first end-piece cover portion extends from the top cover portion 30 for covering a first magnetic shunt end piece. The first end-piece cover portion includes first strut members 34 extending over top portions of the first magnetic shunt end piece and includes a first outer end cover 19 ending downward from the first strut members 34 for covering an outer end of the first magnetic shunt end piece. A second end-piece cover portion extends from the top cover portion 30 for covering a second magnetic shunt end piece. The second end-piece cover portion includes second strut members 32 extending over top portions of the second magnetic shunt end piece and includes a second outer end cover 21 extending downward from the second strut members 32 for covering an outer end of the second magnetic shunt end piece.

Each of the first side cover portion 23 and the second side cover portion 25 includes a mounting strap reception slot 27 for receiving a mounting strap 16 for mounting the magnet array 10 and the support bracket 17 on a oil filter cartridge 14. The magnetic shunt end pieces include concave mounting surfaces for mounting on convex outer surfaces of oil filter cartridges 14.

As shown in FIG. 4, the box-like magnet array 15 is mounted on the oil filter cartridge 14. More specifically, the support bracket 17 is mounted over the box-like magnet array 15, and the mounting strap 16 is threaded through the mounting strap reception slots 27 of the first side cover portion 23 and the second side cover portion 25. For the rectangular end pieces 24, concave mounting surfaces 28 are in contact with the outer surface of the oil filter cartridge 14.

Figure 7:
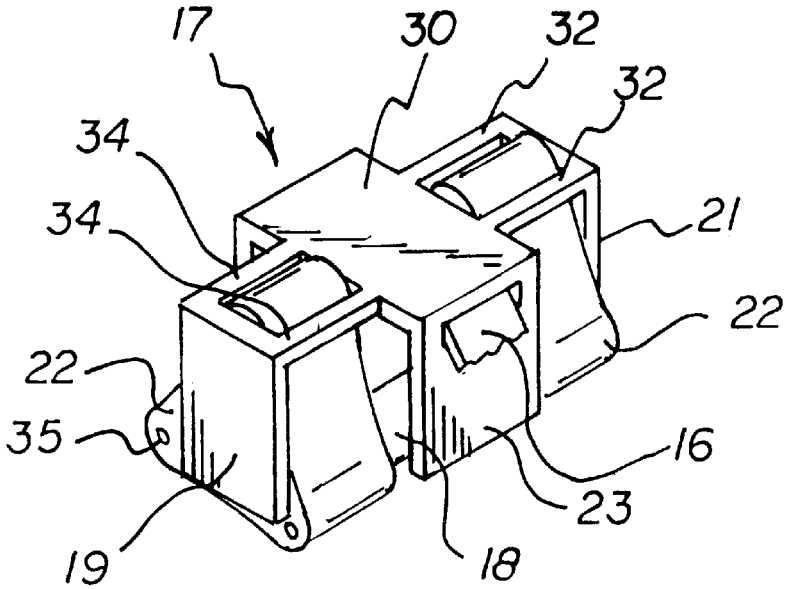
FIG. 7 is a perspective view showing the three-dimensional triangular magnet array of FIG. 2 along with the support bracket and a portion of a connecting strap.

As shown in FIG. 7, the triangular magnet array 13 is mounted on the oil filter cartridge 14 (not shown). More specifically, the support bracket 17 is mounted over the triangular magnet array 13, and the mounting strap 16 is threaded through the mounting strap reception slots 27 of the first side cover portion 23 and the second side cover portion 25. For the triangular end pieces 22, concave mounting surfaces 26 are in contact with the outer surface of the oil filter cartridge 14.

It is further noted with the triangular magnet array 13, an apex of each triangular end piece 22 extends up into a reception frame formed by the top cover portion 30, the respective strut members, and the respective outer end covers. The reception of the respective apexes of the respective triangular end pieces 22 in the respective reception frames helps stabilize the triangular magnet array 13 in the support bracket 17 and on the oil filter cartridge 14.

Figures 8, 9:
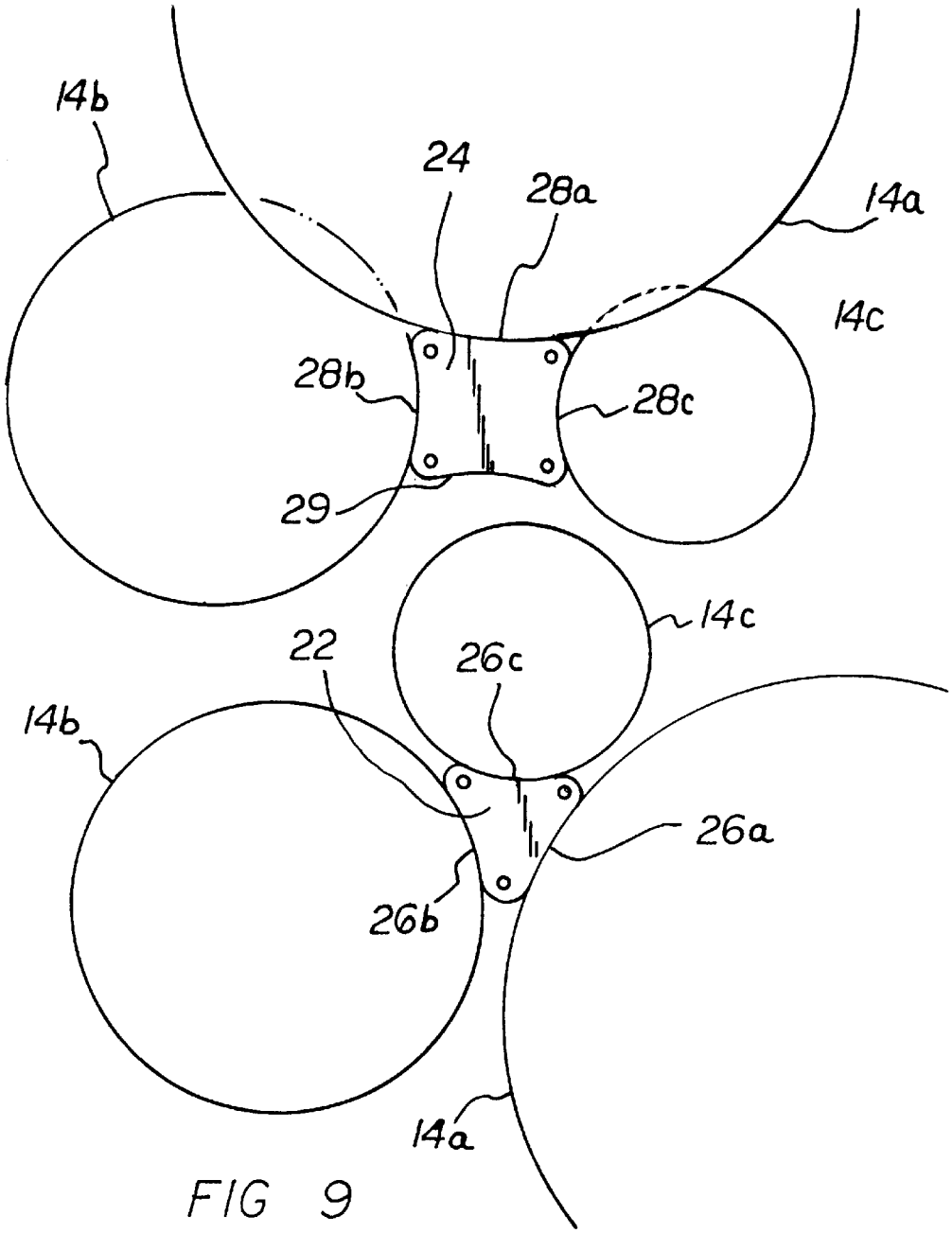
FIG. 8 is an end view of a rectangular end piece having a variety of outer surface radii of curvature for fitting onto a variety of oil filter cartridges having a variety of different radii of curvature.
FIG. 9 is an end view of a triangular end piece having a variety of outer surface radii of curvature for fitting onto a variety of oil filter cartridges having a variety of different radii of curvature.

As shown in FIGS. 8 and 9, each magnetic shunt end piece includes a plurality of concave mounting surfaces has a plurality of different radii of curvature for mounting of different oil filter cartridges has different convex outer surfaces has different radii of curvature. More specifically, as shown in FIG. 8, the rectangular end piece 24 has a first concave mounting surface 28*a* having a first radius of curvature for mounting on a large oil filter cartridge 14*a*. Also, the rectangular end piece 24 has a second concave mounting surface 28*b* having a second radius of curvature for mounting on a medium oil filter cartridge 14*b*. In addition, the rectangular end piece 24 has a third concave mounting surface 28*c* for mounting on a small oil filter cartridge 14*c*. The fourth side of the rectangular end piece 24 is flat.

In addition, as shown in FIG. 9, the triangular end piece 22 has a first concave mounting surface 26*a* having a first radius of curvature for mounting on a large oil filter cartridge 14*a*. Also, the rectangular end piece 24 has a second concave mounting surface 26*b* having a second radius of curvature for mounting on a medium oil filter cartridge 14*b*. In addition, the rectangular end piece 24 has a third concave mounting surface 26*c* having a third radius of curvature for mounting on a small oil filter cartridge 14*c*.

The components of the magnet array and support bracket of the invention can be made from inexpensive and durable metal and high temperature resistant plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved magnet array and support bracket that is low in cost, relatively simple in design and operation, and which may advantageously be used for treatment of engine oil in an oil filter cartridge in a three-dimensional magnet array. With the invention, a magnet array and support bracket is provided which retains a plurality of longitudinally extending magnets in an array wherein the magnets are parallel to one another. With the invention, a magnet array and support bracket provides a three-dimensional magnet array that can be cylindrical in shape, triangular in shape, or box-like in shape. With the invention, a magnet array and support bracket provides a support bracket that can accommodate cylindrical, triangular, and box-like end pieces for the three-dimensional magnet arrays. With the invention, a magnet array and support bracket provides end pieces for the three-dimensional magnet arrays that have a variety of radii of curvature for fitting onto a variety of oil filter cartridges. With the invention, a magnet array and support bracket provides a support bracket for a three-dimensional array of magnets that has means for receiving a strap or band used to attach the magnet array to the oil filter cartridge.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A magnet array, comprising:

a pair of magnetic shunt end pieces, each of which includes an internal face having an internal surface area, and a plurality of magnets aligned parallel to one another and extending between said magnetic shunt end pieces and contacting said internal faces such at said magnetic shunt end pieces said magnets are retained in a stable magnet array by said magnetic shunt end pieces, wherein said magnetic shunt end pieces include:

at least one concave mounting surface for mounting said magnet array on a confronting portion of an article having a convex outer surface.

2. The magnet array of claim 1 wherein said magnets are cylindrical in shape.

3. The magnet array of claim 1 wherein said magnetic shunt end pieces include wire-reception channels for receiving safety wires for binding said magnetic shunt end pieces and said magnets into a secure magnet array.

4. The magnet array of claim 1 wherein each magnetic shunt end piece includes a plurality of concave mounting surfaces having a plurality of different radii of curvature for mounting on different articles having different convex outer surfaces having different radii of curvature.

5. The magnet array of claim 1 wherein said article is an oil filter cartridge.

6. The magnet array of claim 1 wherein said magnetic shunt end pieces are in a form of triangular end pieces, such that a triangular magnet array is formed.

7. The magnet array of claim 6 wherein each of said triangular end pieces includes a concave mounting surface.

8. The magnet array of claim 1 wherein said magnetic shunt end pieces are in a form of rectangular end pieces, such that a box-like magnet array is formed.

9. The magnet array of claim 8 wherein each of said rectangular end pieces includes a concave mounting surface.

10. A magnet array, comprising:

a pair of magnetic shunt end pieces, each of which includes an internal face having an internal surface area, and a plurality of magnets aligned parallel to one another and extending between said magnetic shunt end pieces and contacting said internal faces such at said magnetic shunt end pieces said magnets are retained in a stable magnet array by said magnetic shunt end pieces, further including:

a support bracket for supporting said magnet array on an article having a convex surface, wherein said support bracket includes:

a magnet cover portion which includes a top cover portion, a first side cover portion extending downward from said top cover portion, and a second side cover portion extending downward from said top cover portion, wherein said magnets in said magnet array are covered by said magnet cover portion, a first end-piece cover portion extending from said top cover portion for covering a first magnetic shunt end piece, wherein said first end-piece cover portion includes first strut members extending over top portions of said first magnetic shunt end piece and includes a first outer end cover ending downward from said first strut members for covering an outer end of said first magnetic shunt end piece, and a second end-piece cover portion extending from said top cover portion for covering a second magnetic shunt end piece, wherein said second end-piece cover portion includes second strut members extending over top portions of said second magnetic shunt end piece and includes a second outer end cover ending downward from said second strut members for covering an outer end of said second magnetic shunt end piece.

11. The magnet array of claim 10 wherein each of said first side cover portion and said second side cover portion includes a mounting strap reception slot for receiving a mounting strap for mounting said magnet array and said support bracket on a oil filter cartridge.

12. The magnet array of claim 10 wherein said article having a convex surface is an oil filter cartridge.

* * * * *